United States Patent [19]

Cayle et al.

[11] 3,966,543

[45] June 29, 1976

[54] ENZYME-TREATED PAPER

[75] Inventors: Theodore Cayle, Lake Forest; Gerard J. Moskowitz, Buffalo Grove, both of Ill.

[73] Assignee: Baxter Laboratories, Inc., Deerfield, Ill.

[22] Filed: Oct. 30, 1972

[21] Appl. No.: 302,323

[52] U.S. Cl. ..... 162/158; 195/8; 195/33; 195/63; 195/68

[51] Int. Cl.[2] ..... D21D 3/00

[58] Field of Search ..... 162/158, 158 R, 158 N; 195/8, 33, 63, 68, DIG. 1

[56] References Cited

UNITED STATES PATENTS

| | | | |
|---|---|---|---|
| 2,280,307 | 4/1942 | Diehm | 195/8 |
| 3,021,253 | 2/1962 | Opderbeck et al. | 195/8 |
| 3,041,246 | 6/1962 | Bolaski et al. | 195/8 |
| 3,642,580 | 2/1972 | Ghose | 195/33 |
| 3,645,769 | 2/1972 | Willey et al. | 162/158 |

FOREIGN PATENTS OR APPLICATIONS

| | | | |
|---|---|---|---|
| 758,488 | 5/1967 | Canada | 162/158 |

OTHER PUBLICATIONS

Casey, "Pulp & Paper," 2nd ed., vol. II, pp. 946–947.

Mandels et al., "Production of Cellulases," Advances in Chem. Series 95, (1969), pp. 395, 394.

*Primary Examiner*—Robert L. Lindsay, Jr.

*Assistant Examiner*—Peter Chin

*Attorney, Agent, or Firm*—Louis Altman; Lawrence W. Flynn; Max D. Hensley

[57] ABSTRACT

A dilute, aqueous solution of cellulase enzyme complex is applied to the wet paper web during paper manufacture to improve the disintegratability of the paper during subsequent disposal.

5 Claims, No Drawings

ENZYME-TREATED PAPER

This invention relates to a method for the treatment of paper to facilitate its disintegration upon subsequent disposal.

As a major component of wood, cotton, viscose, pulp, paper and paperboard products, cellulose has been one of man's most abundant and useful natural resources. In view of the high consumption of disposable cellulosic materials in modern society, it is easily understandable that a large proportion of the solid wastes of major urban centers consists of cellulosic materials. These materials can be disposed of by dumping, incinerating or recycling. Of course, dumping or incinerating contributes substantially to urban environmental pollution. Recycling can alleviate various of these pollution problems to a certain degree, but it is not adaptable to all types of cellulosic waste. Consequently, an improved method of facilitating disposal of cellulosic waste products would have significant value at the present time.

In accordance with the present invention, a dilute, aqueous solution of a cellulase enzyme complex is applied to the paper sheet during manufacture and prior to the final drying. The enzyme is thereby incorporated on the paper sheet and provides a latent self-destruct mechanism whereby upon disposal of the waste paper by allowing it to become wetted by water, the paper is more readily and rapidly disintegrated.

Present day paper-making comprises essentially the process of forming a sheet from a dilute suspension of cellulosic fibers followed by pressing and drying the sheet. The fibrous raw materials generally are mechanical pulp or groundwood, or a chemical pulp, namely, sulfite pulp or sulfate (Kraft) pulp, either bleached or unbleached. In the sulfite process, the wood is digested with a solution of calcium bisulfite and and sulfurous acid whereas in the sulfate process, a mixture of caustic soda and sodium sulfide is used.

Paper pulp stock can also be obtained from reclaimed waste paper or from cotton fibers, including linters and small scraps of new cotton cloth.

All paper pulps must be subjected to mechanical action prior to being formed into a paper sheet. This mechanical action generally comprises beating or refining. During beating, the cellulosic fibers are swollen, cut, frayed, macerated and fibrillated in a batch-type beater such as a Hollander. Refining produces similar type physical modifications but on a continuous basis such as with a cone refiner, for example the Jordan, or with a disc refiner, for example in Bauer.

It is known that cellulase enzymes can be employed to facilitate or improve the physical properties of the pulp during the beating or refining step, such treatment being disclosed, for example, by Jenness and Cooper in Canadian Patent No. 758,488. The enzymes are, of course, expended during this treatment and are not available for use as contemplated within the scope of the present invention.

Following the step of beating or refining, the process of forming a sheet from the pulp according to present practice is carried out on a continuous basis. The equipment employed in this process is of two general types, the cylinder machine and the Fourdrinier. In the former, a wire-covered cylinder is mounted for revolving in a vat to which the fiber slurry is introduced. While the cylinder revolves, water drains inwardly through the screen and the paper sheet is formed on the outside. The wet sheet is removed at the top of the cylinder, passed through a series of press rolls and then is sent to steam-heated cylindrical drying drums.

The Fourdrinier comprises essentially an extended continuous wire screen supported by various means to facilitate drainage. The fiber slurry is introduced at one end of the machine through a headbox and slice, loses water as it progresses down the wire, and the paper sheet is thereby formed. The sheet then passes to presses and dryers in a manner much the same as with the cylinder paper-making machine.

It is at the stage following the formation of the sheet such as with the cylinder machine or Fourdrinier that the method of the present invention is applied. After the sheet leaves the cylinder or the Fourdrinier wire, the wet paper web can be conveniently sprayed with a dilute, aqueous solution of the cellulase enzyme complex or it can be pressed and then passed through a vat or similar such container to which said solution of the cellulase enzyme complex is introduced. Following treatment with the enzyme solution, the wet paper web can then be carried to the presses and dryers.

After treatment with the enzyme solution, the sheet will contain about 75–80% water. A substantial portion of that water is removed mechanically in rotary presses. The wet web is generally carried through these presses on continuous felts, which act as conveyors and porous receptors and thereby markedly increase the effectiveness of water removal. This pressing will usually reduce the water content of the sheet to about 65–70%.

After pressing, the sheet is carried to the dryer section which generally comprises a series of steam-heated cylinders, with alternate sides of the wet being exposed to the hot surface as it passes from cylinder to cylinder. Heat is thus transferred from the hot cylinder to the wet web and water is thereby evaporated. The drying step can also be carried out with a Yankee dryer, especially on tissues where creping is desired as described, for example, in Sanford and Sisson, U.S. Pat. No. 3,301,746. High-velocity air drying whereby evaporated water is removed by hot air impinging on the surface of the web, infrared and other radiant-heat drying also can be used following the enzyme treatment and pressing of the wet web. The final moisture content of the dry sheet is then in the range of about 4–6%.

In the drying step, it is preferred that the temperature of the paper sheet is not raised above about 100°C. in order to avoid loss of the latent enzyme activity in the cellulase enzyme complex which has been incorporated on the paper sheet prior to drying.

It is known that cellulase enzymes contain various components, particularly the $C_1$, $C_x$ and $\beta$-glucosidase components. These cellulase components are described in detail in article by King and Vessal entitled "Enzymes of the Cellulase Complex" appearing in the *Advances in Chemistry Series* 95, 1969, at pp. 7–25, entitled "Cellulases and Their Applications", published by the American Chemical Society. The cellulase enzyme employed in accordance with the present invention is a complex cellulase which contains both the $C_1$-component and the $C_x$-components; exo-$\beta$-1 → 4 glucanase and endo-$\beta$-1 → 4 glucanase. The $C_1$-component is critical for treatment of crystalline cellulose as in paper and paper products treated in accordance with the present invention. Cellulase enzymes with only $C_x$-components have been found to be unsuitable for carrying out the present invention.

Preferably, the cellulase complex will contain at least five units each of $C_1$ and $C_x$ enzyme activity per ml. These activity units can be determined by production of reducing sugar measured as glucose by a dinitrosalicylic acid (DNS) method described in detail in an article by Mandels and Weber entitled "The Production of Cellulases" appearing in the *Advances in Chemistry Series* 95, 1969, cited above, at pp. 391–413. Generally, the cellulase complex will contain substantially more than five units of $C_x$ activity and preferably also more than five units of $C_1$ activity.

The cellulase complex can be obtained from various natural sources and particularly microbial sources such as *Trichoderma viride*, *Penicillium variable*, *Myrothecium verrucaria*, *Chrysosporium pruinosum*, *Penicillium pusillum*, *Fusarium moniliforme*, *Aspergillus terreus* and various Basidiomycetes.

The preferred microbial source of the enzyme complex used in this invention is *Trichoderma viride*. *Trichoderma viride* is a common and well known species of microorganism described in the aforementioned *Advances in Chemistry Series* 95, 1969, p. 1 et seq. Suitable cultures of this species are available in recognized depositories affording permanance of the deposit and ready accessibility thereto by the public. Examples of these culture deposits are those in the permanent collections of the Northern Utilization and Research Division, Agricultural Research Service, U.S Department of Agriculture, Peoria, Ill., under accession number NRRL 3153; the American Type Culture Collection, Rockville, Md., under the deposit numbers ATCC 14,910 and 16,325; and the U.S. Army Natick Laboratories, Natick, Mass., identified as Army Quartermaster Strain QM 9123.

Production of the cellulase complex from *Trichoderma viride* is well-known and described, for example, in U.S. Pat. Nos. 3,160,569; 3,398,055; and 3,642,580; French Patent 1,588,216; German Patent 1,233,358; and Japanese Patents 14,364 (1963); 11,912 (1965); and 24,275 (1965).

These production procedures generally involve submerged or surface fermentation in a suitable inoculated culture medium. Commercially available products are "Cellulase 5000" from Ueda Chemical Industries, Co., Ltd. and "Cellulase onozuka" and "Meicelase" from Meiji Seika Co., Ltd.

The amount of enzyme employed in the process of this invention can vary within wide limits and will depend in part upon the type and grade of paper which is treated and the unit activity of the particular cellulase enzyme complex employed. Thus, with standard paper hand towels, 11 in. × 11 in., 2 ply, ten grams of towel or 2.66 sheets begin to disintegrate within about three weeks in water when treated with about 100 $C_1$-units of cellulase per gram of paper. At a level of 400 $C_1$-units of cellulase per gram of paper the disintegration is much more pronounced in three weeks and is complete in about one month. On the other hand, paper towels that have been treated to give added wet-strength to the sheet generally require more than about 1000 $C_1$-units of cellulase per gram of paper. In the case of ordinary newspaper, ten grams of paper begin to disintegrate in about four and one-half weeks in water when treated with about 200 $C_1$-units of cellulase per gram of paper. At a level of 400 $C_1$-units of cellulase per gram of paper the disintegration is noticeable within one week and is considerable in about four and one-half weeks. In the case of ordinary facial and toilet tissues treated with about 50 $C_1$-units of cellulase per gram of paper, the disintegration in water is complete within about 2 to 4 weeks. Selection of a suitable amount of enzyme also can be had by further reference to the following illustrative examples.

Although the following examples will further illustrate the invention, it will be understood that the invention is not limited to these specific examples. The cellulase referred to in these examples was obtained from *Trichoderma viride* QM 9123 and contained more than 5 units each of $C_1$ and $C_x$ components per ml. These activity units were determined as follows:

$C_1$ Assay

The solution containing the enzyme is incubated at 50°C. for one hour with 400 mg. of "AVICEL" microcrystalline cellulose (American Viscose) at pH 4.8 in a final volume of 6.0 ml. One unit of enzyme activity is defined as that amount of enzyme required to produce 0.5 mg. glucose equivalents in the reaction mixture. Reducing sugars are determined according to the DNS method of Mandels and Weber, *Advances in Chemistry Series* 95, 1969, cited above, at page 393.

$C_x$ Assay

The solution containing the enzyme is incubated at 35°C. for one hour with a 5% solution of sodium carboxymethyl-cellulose at pH 5.0. One unit of enzyme activity is defined as that amount of enzyme required to reduce the viscosity of the mixture from 400 to 300 centipoise (Brookfield Viscometer, Model LVF, Spindle No. 1, 12 RPM) under the stated conditions.

EXAMPLE 1

Samples of "Scot Towels" brand, one-ply, 11 in. × 9.4 in., absorbent paper towels manufactured as described in U.S. Pat. No. 2,834,809, (4 sheets each sample) were each dipped in 500 ml. of a solution containing a total of 123,000 $C_1$-units of cellulase in 0.04 molar citrate buffer, pH 4.8, and hung up to dry at various temperatures in a draft oven. Four sheets each treated in the foregoing manner were dried at, respectively, 25°C., 50°C., 60°C., 70°C., 80°C., 90°C. and 100°C. The towels were then stored at room temperature for about five weeks, during which time they remained intact and indistinguishable from untreated towels. Following said storage, the towels were suspended in water (1 sheet/200 ml. containing 0.001% merthiolate bactericide) in a covered jar at room temperature. Within four days all towels were substantially disintegrated whereas a non-enzyme treated towel, which was used as a control, did not disintegrate during similar soaking.

EXAMPLE 2

A sheet of "The New York Times" newspaper (11 grams) was suspended in 500 ml. of a solution containing 0.05 molar cirtrate buffer, pH 4.8, 325 $C_1$-units of cellulase, and 0.001% merthiolate as a preservative. Also suspended in the above solution were several sheets of "Whatman" filter paper, No. 42, each 9 cm. in diameter. After two weeks of soaking, the filter paper began to show signs of disintegration. The filter paper assumed a more waxy appearance, and on shaking, gave rise to fibrous material and began to shred. The newspaper at this point began to show signs of disintegration including some fibrous material floating in solution, but remained essentially intact. After ten weeks of soaking, the newspaper had disintegrated into freely floating fibers and small particles of paper about one-half inch in diameter. About one-fourth of the newspaper was still intact although easily disintegrated when rubbed by hand. The filter paper, except for about one-sixth of the total, which remained as an undigested core, was completely disintegrated into floating fibers upon shaking. By way of comparison, non-enzyme treated control samples of newspaper and filter paper did not disintegrate during similar soaking.

EXAMPLE 3

Samples of "Whatman" filter paper, No. 42, each 7 cm. in diameter, were dipped in aqueous solutions of cellulase containing, respectively, 122 $C_1$-units per ml., 12.2 $C_1$-units per ml., 1.2 $C_1$-units per ml. and a control solution without enzyme, and then air dried. After four weeks in the dry state, the papers were suspended in 10 ml. of water containing 0.1 ml. of a 0.1% merthiolate solution bactericide and incubated at room temperature. After four weeks of soaking, the paper dipped in the solution having the highest enzyme concentration began to disintegrate. The other papers were unaffected. After six weeks of soaking, further disintegration of the 122 $C_1$-units per ml. -dipped paper occurred, although not enough to cause complete destruction of the paper. The other papers remained unaffected.

EXAMPLE 4 a. A wet paper web of standard paper toweling having a dry basis weight of 28.8 pounds per 3000 square feet is sprayed with a dilute, aqueous solution of cellulase at the point of departure from the Fourdrinier wire and then passed into conventional press rolls followed by drying. The paper web is formed on a paper making machine having a trimmed machine width of 67 ½ inches and operating at a speed of 500 feet per minute. The enzyme is applied to the wet paper web at a rate of $2.5 \times 10^6$ $C_1$-units per minute to cover 2790 square feet by spraying at the rate of one liter per minute with an aqueous enzyme solution containing 93 grams of cellulase per liter of solution and having a specific activity of 27,000 $C_1$-units per gram of enzyme. The final dry paper toweling is then stored at room temperature for four weeks, after which time it is allowed to soak in water. After four weeks, the paper is substantially disintegrated.

b. A wet paper web of standard newsprint having a dry basis weight of 89.8 pounds per square feet is enzyme-treated prior to pressing and drying as in Example 4(a) except that the concentration of cellulase in the aqueous solution is 290 grams per liter. The finished paper is allowed to soak in water and after four weeks substantial disintegration of the paper occurs.

EXAMPLE 5

Examples 4 (a) and (b) are repeated except that instead of spraying an enzyme solution onto the wet paper web as it leaves the Fourdrinier wire, the paper web is first passed through press rolls and then the enzyme is applied by passing the paper web through an aqueous solution of enzyme in a vat, after which treatment conventional pressing and drying of the paper web is carried out. The following concentrations of enzyme solutions are used:

a. In the case of the standard paper toweling the aqueous enzyme solution has a concentration of 1300 $C_1$ cellulase units per 100 ml.;

b. In the case of the standard newsprint the aqueous enzyme solution has a concentration of 4700 $C_1$ cellulase units per 100 ml.

EXAMPLE 6

Examples 5 (a) and (b) are repeated except that the enzyme solution is applied onto the wet paper web by passage over press rolls used in pressing the paper web.

The enzyme-treated papers of Examples 5 and 6 disintegrate upon soaking in water in a manner similar to the papers in Example 4. Substantially similar results as in Examples 4 to 6 are obtained when equivalent amounts of the cellulase enzyme are sprayed on the wet paper webs from paper machines with trimmed machine widths ranging up to 300 inches and at machine speeds ranging up to 5000 feet per minute. Thus, the present invention is useful in commercial paper making operations and can be advantageously employed without any substantial changes to the conventional equipment and procedures including the drying of the wet paper web up to temperatures of 100°C. without loss of enzyme activity.

Various other examples and modifications of the foregoing examples will be apparent to the person skilled in the art after reading the above disclosure and the appended claims without departing from the spirit and scope of the invention. All such further examples are included within the scope of the appended claims.

We claim:

1. A process for improving the disintegratability of moistened paper comprising applying a dilute aqueous solution of a cellulase enzyme complex containing at least about five units each of $C_1$- and $C_x$-components of enzyme activity per ml. of said solution to newly formed paper after leaving the forming section but prior to entering the drying section so that said paper contains from about 75% to about 80% water after said application, followed by drying in which the temperature of said paper is not raised above about 100°C, the amount of said complex being such as to provide at least about 50 $C_1$ units per gram of paper.

2. The process of claim 1 in which the cellulase enzyme complex is obtained from *Trichoderma viride*.

3. The process of claim 2 in which the *Trichoderma viride* is the strain number QM 9123.

4. A cellulosic fiber paper in disposable form comprising cellulosic fibers and cellulase with latent enzymatic action, and the cellulase being present in sufficient amount to substantially enhance the disintegration of the paper when exposed to moist conditions.

5. A process for producing a cellulosic fiber paper having improved disintegration properties when exposed to moist conditions, comprising the steps of impregnating the cellulosic fiber paper with cellulase and drying said impregnated paper to form a paper containing cellulase with latent enzymatic action.

* * * * *